US006755733B2

(12) United States Patent
Horiguchi et al.

(10) Patent No.: US 6,755,733 B2
(45) Date of Patent: Jun. 29, 2004

(54) IMAGE FORMING APPARATUS

(75) Inventors: Shigeru Horiguchi, Kanagawa (JP); Yuji Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/206,758

(22) Filed: Jul. 29, 2002

(65) Prior Publication Data

US 2002/0185809 A1 Dec. 12, 2002

Related U.S. Application Data

(62) Division of application No. 09/200,751, filed on Nov. 30, 1998.

(30) Foreign Application Priority Data

Nov. 28, 1997 (JP) ..... 9-327455
Nov. 28, 1997 (JP) ..... 9-327978
Nov. 28, 1997 (JP) ..... 9-344090

(51) Int. Cl.[7] ..... H05K 7/20
(52) U.S. Cl. ..... 454/184; 312/236
(58) Field of Search ..... 454/184; 361/678, 361/691, 695; 312/236

(56) References Cited

U.S. PATENT DOCUMENTS 4,710,851 A * 12/1987 Pastecki ..... 361/687
5,657,641 A * 8/1997 Cunningham et al. ..... 62/263
5,876,278 A * 3/1999 Cheng ..... 454/184
6,174,231 B1 * 1/2001 Bodin ..... 454/184

FOREIGN PATENT DOCUMENTS

| | | |
|---|---|---|
| JP | 58-38155 | 3/1983 |
| JP | 1-58559 | 4/1989 |
| JP | 3-38860 | 4/1991 |
| JP | 8-337347 | 12/1996 |
| JP | 9-194107 | 7/1997 |
| JP | 9-301602 | 11/1997 |

OTHER PUBLICATIONS

U.S. patent application Ser. No. 10/206,758, Horiguchi et al., filed Jul. 29, 2002.

U.S. patent application Ser. No. 10/358,322, Sakaguchi et al., filed Feb. 5, 2003.

* cited by examiner

*Primary Examiner*—Harold Joyce
(74) *Attorney, Agent, or Firm*—Oblon, Spivak, McClelland, Maier & Neustadt, P.C.

(57) ABSTRACT

A tray for stacking papers formed with images by an image forming apparatus and an arrangement for discharging air from the inside to the outside of the apparatus. A ventilation portion is disposed on the back surface of the apparatus whereby hot air produced by, e.g., a fixing unit is prevented from reaching the operator of the apparatus.

8 Claims, 15 Drawing Sheets

IMAGE FORMING APPARATUS

BACKGROUND OF THE INVENTION

The present invention relates to a copier, facsimile apparatus, printer or similar image forming apparatus and more particularly to an improvement in a tray for stacking papers formed with images and an improvement in an arrangement for ventilating an image forming apparatus.

In an image forming apparatus, papers formed with images are sequentially stacked on a tray. Generally, when images are continuously formed on consecutive papers, the papers stacked on the tray are transported away from the apparatus after the completion of image formation. The tray must therefore be strong enough to withstand the weight of such a stack of papers. To increase the strength of the tray, the thickness of the tray may be increased. However, when the tray is implemented as a molding of resin, an increase in the thickness of the tray results in an increase in the required amount of resin and therefore cost. For this reason, the thickness and therefore volume of the tray cannot be increased beyond a certain limit. It follows that the tray unavoidably bends due to the weight of papers stacked thereon. The papers, however, must be preventing from slipping down despite the bend of the tray.

To reduce the area to be occupied by the apparatus, a space is sometimes formed in the apparatus body and open to the outside at at least one side thereof. In this case, a portion of the casing of the apparatus forming the bottom of the above space plays the role of a tray. When an inner tray is disposed in the space in order to use the space more efficiently, it obstructs, when bent downward, the discharge of papers onto the tray implemented by the bottom of the space and makes it difficult for the operator to pick up the papers from the tray.

It is a common practice to provide a tray for use with an image forming apparatus with a foldable configuration in order to reduce the overall size of the apparatus when the apparatus is not used. This kind of tray is foldable upward at its intermediate portion, so that it protrudes from the apparatus little. An anti-roll or stiffening member may be positioned on the tray at substantially the center in the widthwise direction of a paper. The anti-roll member stiffens consecutive papers and thereby promotes neat stacking of the papers on the tray.

A tray capable of being rotated and stiffening papers with an anti-roll member has recently been proposed. The anti-roll member associated with this tray is removable from the tray because it interferes with a part of the tray during the rotation of the tray. This, however, brings about a problem that the operator must remove the anti-roll member from the tray every time the operator desires to rotate the tray. Should the tray with the anti-roll member be forcibly rotated, the anti-roll member would be damaged.

On the other hand, an image forming apparatus includes many parts and units generating heat during the operation of the apparatus. It has been customary to provide the apparatus with an exhaust fan and a vent for forcibly discharging air inside the apparatus. A current trend in, e.g., the copier art is toward a configuration capable of closely contacting, e.g., the wall of a room and therefore saving the space. However, a wall adjoining the vent critically lowers the ventilation efficiency available with the fan and makes the ventilation arrangement meaningless. Even a vent formed in one side of the apparatus body gives rise to the following problem. Assume that the apparatus is situated in a space closed at three sides by walls. Then, hot air emitted from the side of the apparatus body flows upward along the walls and immediately reaches the body, particularly the face and hands, of the operator. While the vent may be formed in the rear of the apparatus body and directed upward, as also proposed in the past, such a vent allows dust and other impurities thereinto while failing to prevent hot air from reaching the operator's face.

SUMMARY OF THE INVENTION

It is therefore a first object of the present invention to provide an image forming apparatus with a tray capable of obviating troubles ascribable to its deformation caused by the weight of papers without resorting to reinforcement, i.e., an increase in volume.

It is a second object of the present invention to provide an image forming apparatus with a tray free from the interference of an anti-roll member when rotated.

It is a third object of the present invention to provide an image forming apparatus causing a minimum of hot air ascribable to, e.g., a fixing unit to reach the operator.

In accordance with the present invention, in an image forming apparatus including a tray for stacking papers formed with images, the tray is partly bent upward to form a bent portion.

Also, in accordance with the present invention, an image forming apparatus includes an apparatus body, and a stepped portion formed on the rear of the apparatus body and including an upper part protruding to the rear more than a lower part. The stepped portion includes an air outlet for directing air emitted from the apparatus body by ventilating means downward.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
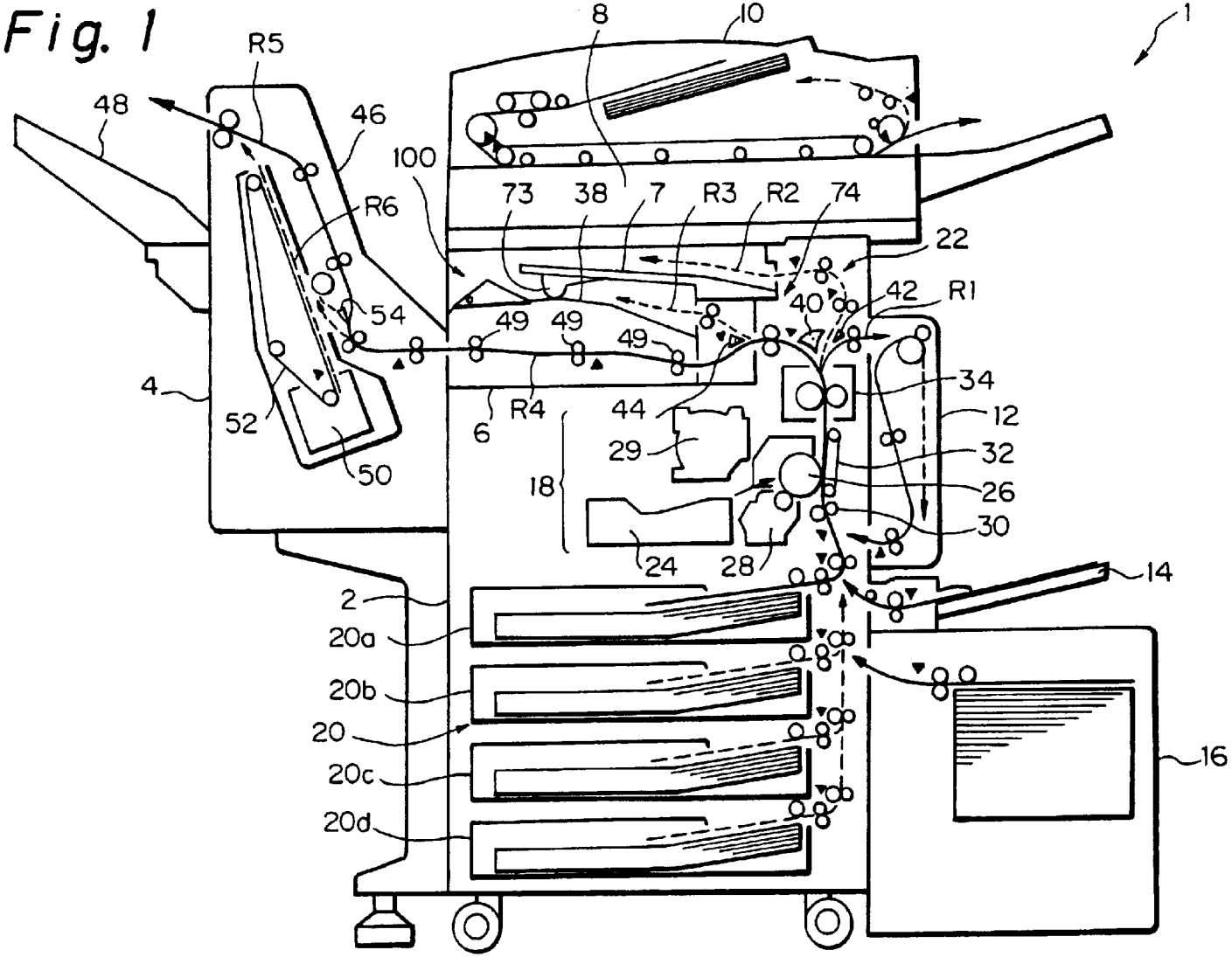
FIG. 1 shows a first embodiment of the image forming apparatus in accordance with the present invention.

Preferred embodiments of the image forming apparatus in accordance with the present invention will be described hereinafter. It is to be noted that identical reference numerals in the illustrative embodiments do not always designate identical structural elements.

First Embodiment

A first embodiment of the present invention is directed toward the first object mentioned earlier and will be described with reference mainly to FIGS. 1–6.

As shown in FIG. 1, an image forming apparatus, generally 1, includes an apparatus body 2. A finisher 4 is mounted to the left side of the apparatus body, as viewed in FIG. 1. Transfer conveying means 6 in the form of a unit is arranged in the apparatus body 2 for transferring papers sequentially driven out of the apparatus body 2 to the finisher 4. An inner tray 7 is positioned above the transfer conveying means 6. A scanner 8 is positioned on the top of the apparatus body 2. An ADF (Automatic Document Feeder) 10 is mounted on the apparatus body 2 above the scanner 8. An automatic duplex made unit 12 is arranged at the side of the apparatus body 2 opposite to the side where the finisher 4 is present. Also included in the apparatus 1 are a manual feed tray 14 and a mass paper feed tray 16.

A space 100 is formed in the apparatus body 2 and delimited by a tray 38 at its bottom. The tray 38 forms the top of the transfer conveying means 6. The space 100 is open to the outside at the front side in the direction perpendicular to the sheet surfaces of FIGS. 1 and 2, or at the right side s viewed in FIG. 3, and at the left side of FIGS. 1 and 2, or at the front aide in the direction perpendicular to the sheet surface of FIG. 3. The inner tray 7 is positioned in the space 100. The scanner 8 and ADF 10 each has a conventional configuration and will not be described specifically. In FIG. 1, a number of solid triangles are representative of paper sensors.

In the apparatus body 2, an image forming section 18 is positioned at the center while a paper feed section 20 and a paper discharge section 22 are respectively positioned below and above the image forming section 18 (so-called vertical transport path structure). An image is formed on a paper being conveyed upward in the substantially vertical direction along the side of the apparatus body 2 where the automatic duplex mode unit 12 is located.

In the image forming section 18, a writing unit 24 electrostatically forms a latent image on a photoconductive drum 26 in accordance with image data received from the scanner 8 or a personal computer not shown. A developing unit 28 develops the latent image with toner. The reference numeral 28 designates a device for replenishing a developer to the developing unit 29.

Papers of a size automatically selected or selected by the operator on an operation panel 21 are sequentially fed from one of a plurality of cassettes 20*a*, 20*b*, 20*c* and 20*d* included in the paper feed section 20. The operation panel 21 is positioned at the front in the direction perpendicular to FIG. 2, i.e., at the right side of FIG. 3. Each paper is conveyed to an image transfer station by a registration roller 30 such that its leading edge meets the leading edge of a toner image formed on the drum 26. Image transferring means 32 is located at the image transfer station for transferring the toner image from the drum 26 to the paper. A fixing unit 34 fixes the toner image on the paper. The paper with the fixed toner image is conveyed to the paper discharge section 22.

In the illustrative embodiment, the paper discharge section 22 has four different discharge routes R, R2, R3 and R4. The route R1, indicated by a solid line, extends to the automatic duplex mode unit 12. The route R2, indicated by a dotted line, extends to the inner tray 7. The route R3, indicated by a dotted line, extends to the tray 38. The route R4, indicated by a solid line, extends to the finisher 4 via the transfer conveying means 6.

Path selectors 40 and 42 are used to select either one of the routes R1 and R2. In addition, the path selector 40 and a path selector 44 are used to select either one of the routes R3 and R4.

The paper brought to the automatic duplex mode unit 12 along the route R1 is switched back in the unit 12 and then conveyed to a substantially vertical path at a position short of the registration roller 30. When the paper is fed from the manual feed tray 14 or the mass paper feed tray 16, it is introduced into the substantially vertical path in the direction indicated by an arrow.

In the finisher 4, the tray 38 has an extension 46 playing the role of a part of the tray 38 when the paper size is greater than a preselected size. The finisher 4 additionally includes a tray 48. A stapler 50 for stapling a stack of papers is disposed in the finisher 4. Also disposed in the finisher 4 is discharging means 52 for lifting the papers stapled by the stapler 50 to the tray 48.

The route R4 extending to the finisher 4 branches into a route R5 (solid line) for directly discharges consecutive papers to the tray 48 without finishing them, and a route R5 (dotted line) for conveying the papers to the tray 48 after finishing them. A path selector 54 selects either one of the paths R5 and R6 at a time.

The top of the tray 38 is enclosed by a cover and is rotatable to facilitate the removal of a jamming paper. A projection is formed integrally with the intermediate portion of the tray 38 in order to reduce resistance to act between the tray 38 and the paper. A plurality of rollers 49 are arranged in the transfer conveying means 6 for conveying consecutive papers formed with images to the finisher 4.

Figure 2:
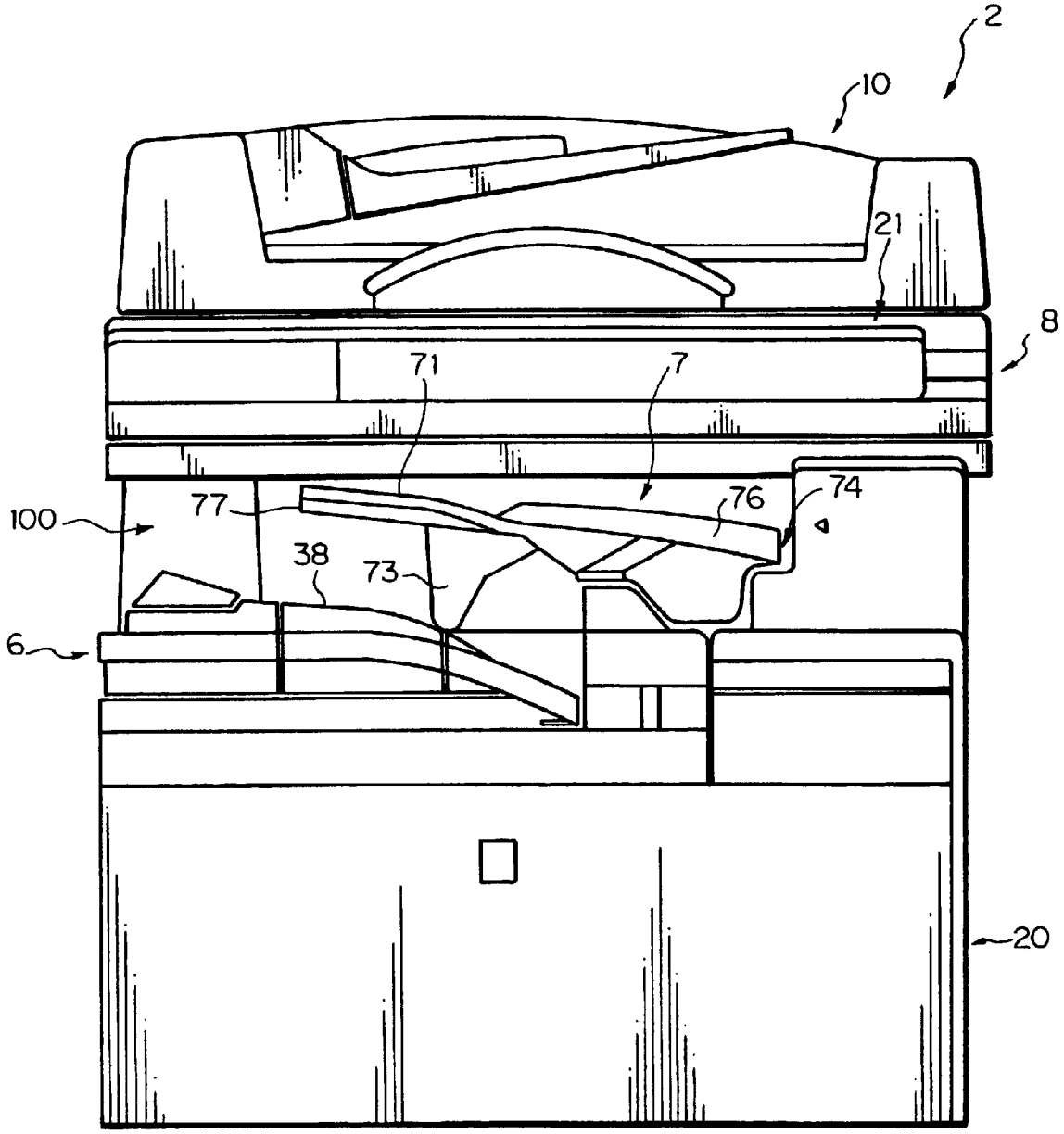
FIG. 2 is a front view showing the apparatus of FIG. 1.
Figure 3:
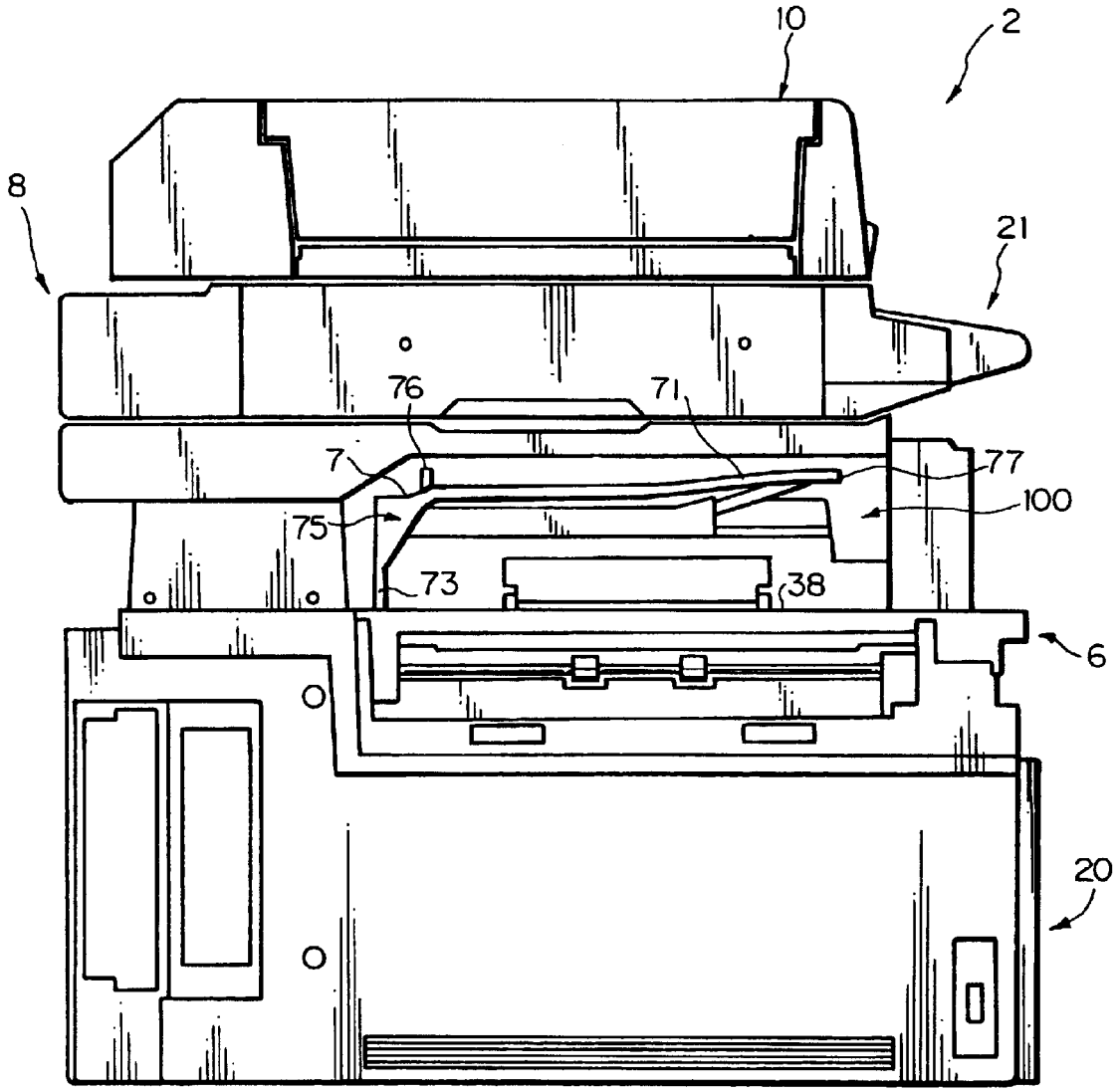
FIG. 3 is a side elevation of the apparatus of FIG. 1 as viewed from the left.

The inner tray 7 is affixed to the apparatus body 2 at the upstream side in the direction in which papers are driven onto the inner tray 7, i.e., at the left side 74 in FIGS. 1 and 2 or the rear side (74) in the direction perpendicular to the sheet surface of FIG. 3. A leg 73 extends downward from the inner tray 7 at the upstream side in the direction in which papers are picked up by the operator, i.e., at the left side 75 shown in FIG. 3 or the rear side (75) in the direction perpendicular to the sheet surfaces of FIGS. 1 and 2. The leg 73 rests on the side portion of the tray 38 and is thereby supported by the apparatus body 2. The downstream side of the inner tray 7 in the direction of paper conveyance is inclined upward.

Figure 4:
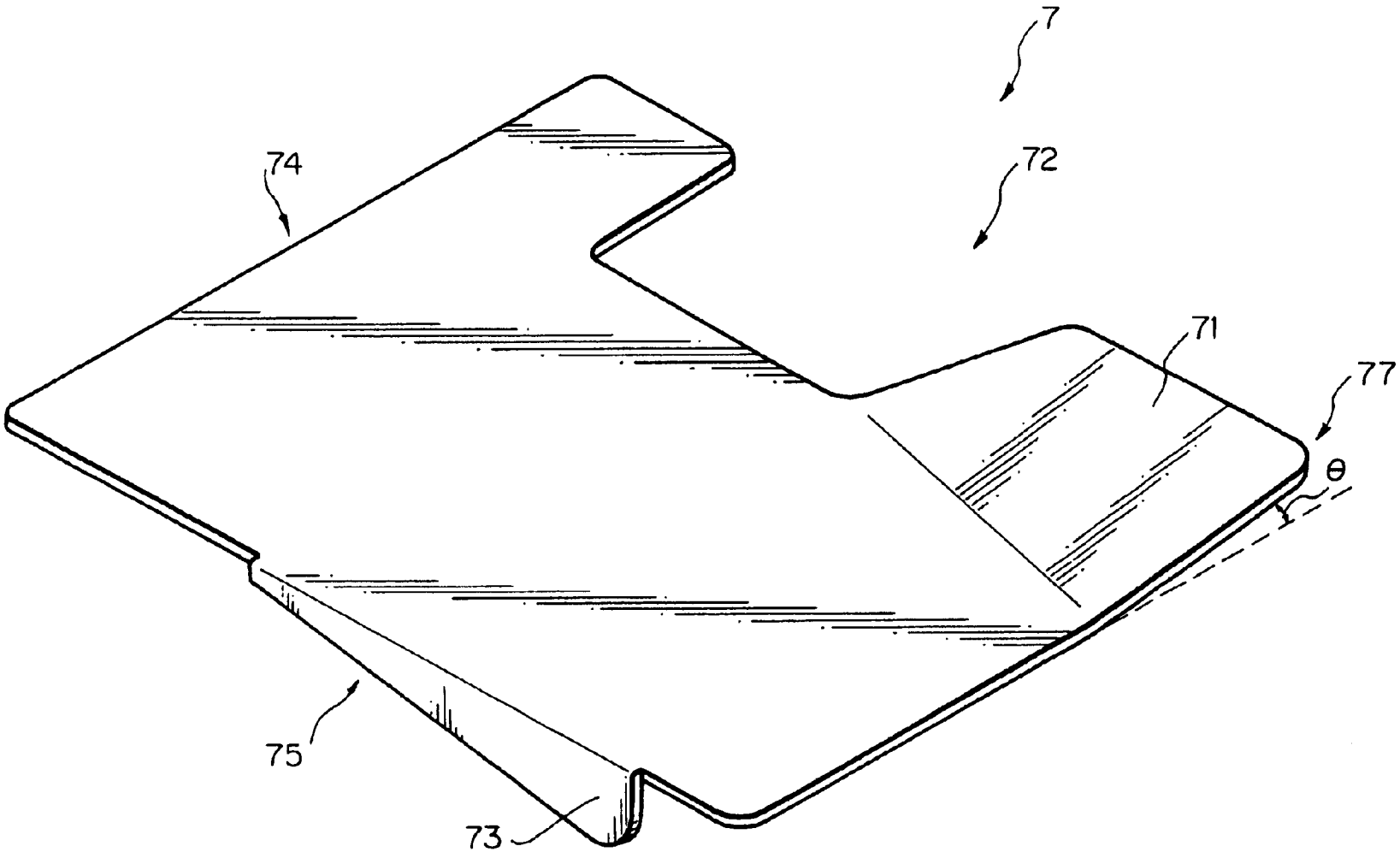
FIGS. 4–6 show an inner tray included in the apparatus of FIG. 1.

As shown in FIG. 4 specifically, the inner tray 7 includes a bent portion 71 and a notch 72 in addition to the leg 73. The other portion of the inner tray 7 is flat. The bent portion 7 is a part of the inner tray 7 which is displaced downward most when papers are stacked on the tray 7 due to the weight of the papers. Specifically, assume a rectangle having one side defined by the side 74 and another side defined by the side 75. Then, the bent portion 71 is so positioned as to contain a corner 77 diagonally opposite to the corner between the above two sides. The bent portion 71 is bent upward away from the horizontal by an angle θ such that the corner 77 is positioned at the highest level. As for the notch 72, the inner tray 7 is notched at the intermediate portion of the side facing the side 75, i.e., the downstream side in the direction in which papers are picked up by the operator. The notch 72 facilitates the removal of papers from the inner tray 7.

Figure 5:
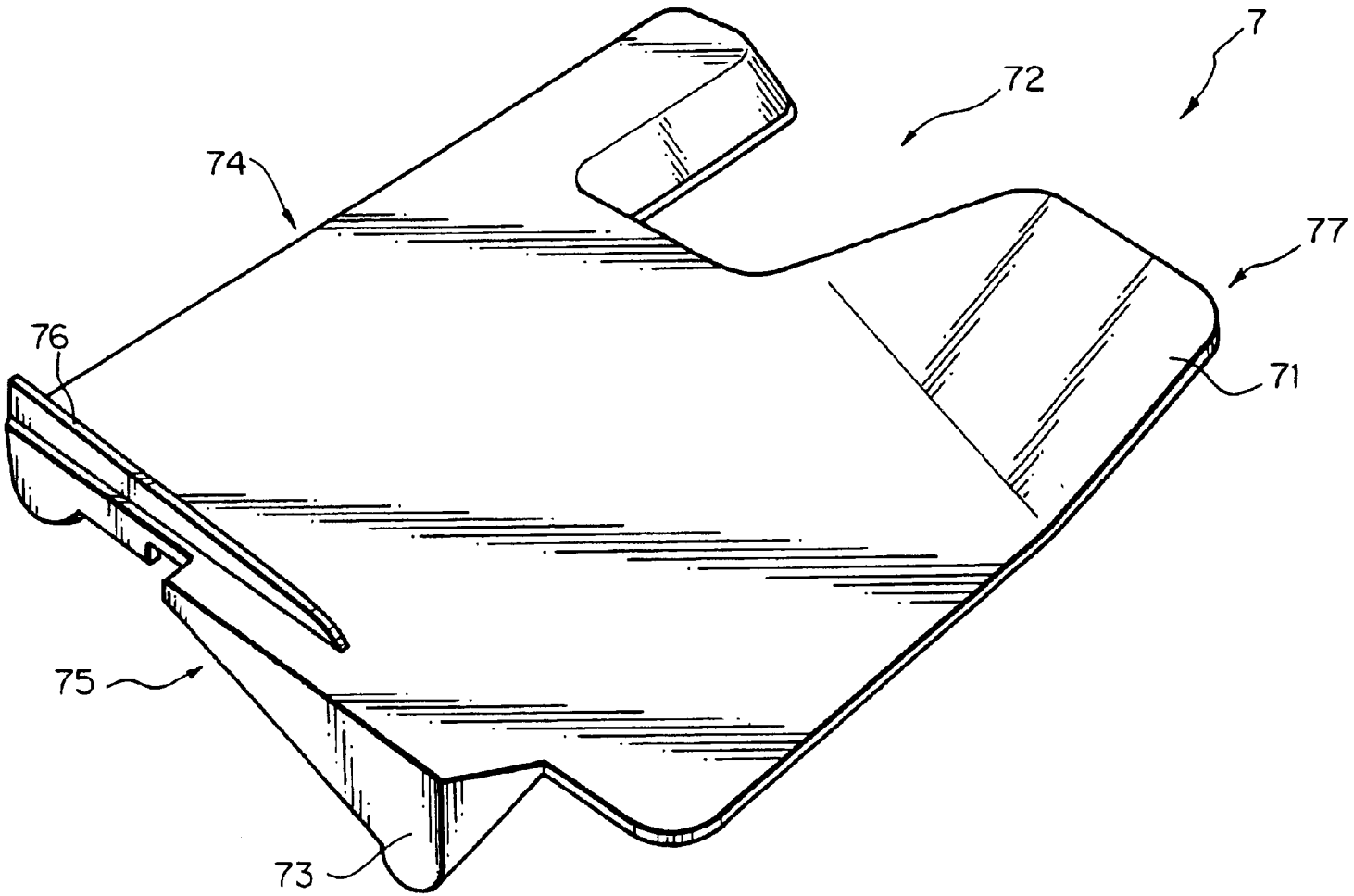
Figure 6:
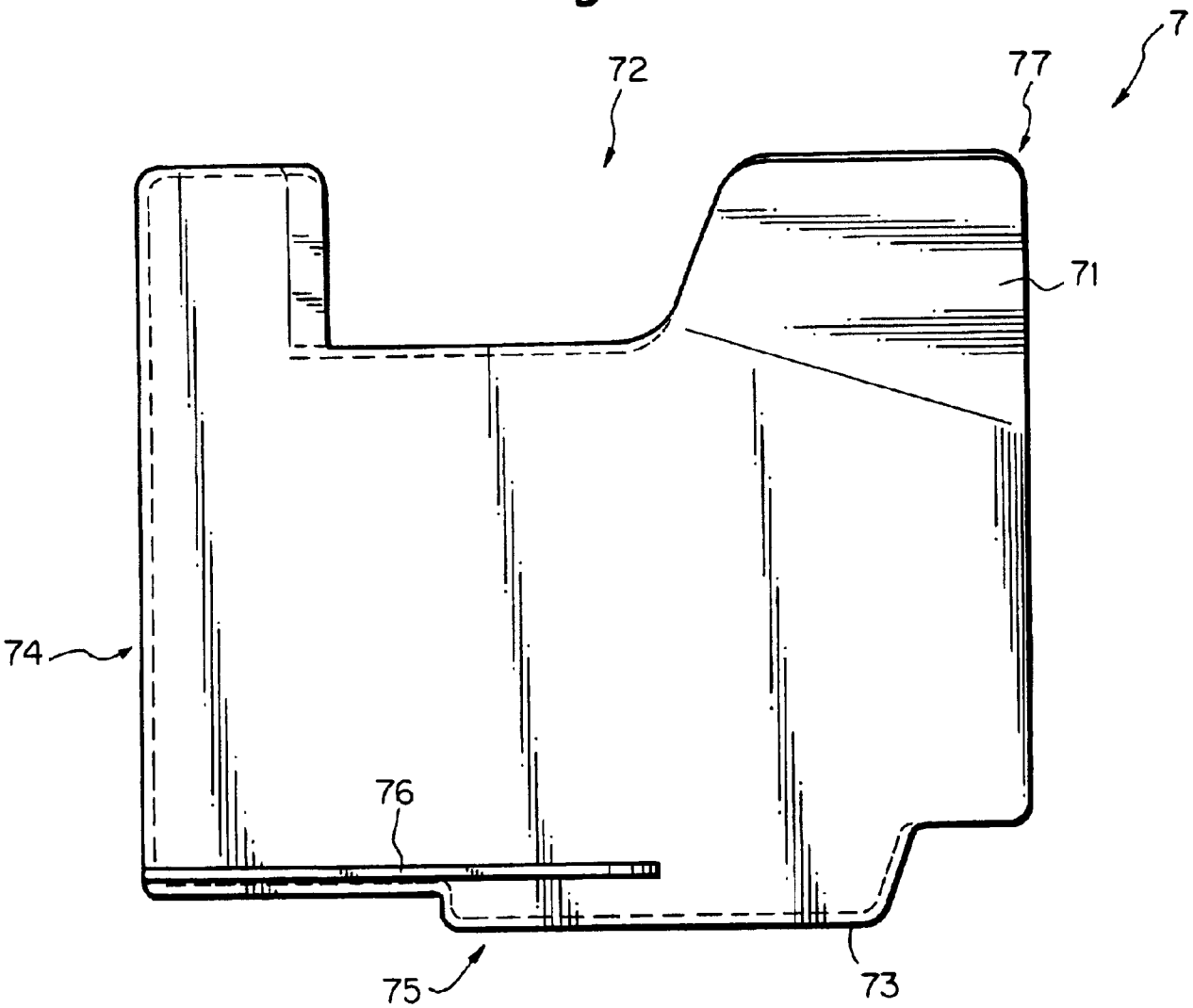

As shown in FIGS. 2, 3, 5 and specifically, a rib 76 protrudes upward from the side 75 of the inner tray 7 and extends from the side 74 toward the center of the tray 7. The rib 76 serves to position papers sequentially stacked on the inner tray 7.

In operation, assume that a paper formed with an image is conveyed to the inner tray 7 via the route R2. Then, the paper is returned to the upstream side in the direction of paper conveyance because the inner tray 7 is inclined upward at its downstream side and because the tray 7 includes the bent portion 71. As a result, the paper is positioned at the side 74. In addition, the paper is positioned at the side 75 because the bent portion 71 causes the paper to abut against the rib 76.

When a number of papers are sequentially stacked on the inner tray 7 in, e.g., a continuous discharge mode, the tray 7 begins to bend due to the weight of the papers. As a result, the bent portion 71 not directly supported by the apparatus body 2 is displaced to the lowermost position. However, because the bent portion 71 is originally bent upward by the angle θ, the corner 77 does not move downward below a plane containing the major flat portion of the tray 7. This prevents the paper stack from slipping down to the outside of the space 100. The operator can easily pick up the paper stack from the tray 7 by nipping it at the notch 72.

Further, assume that when the operator picks up papers stacked on the tray 38, papers are also present on the inner tray 7 and have caused the inner tray 7 to bend. Even in this condition, the operator can readily pick up the papers from the tray 38 because the portion of the tray 7 around the corner 77 bent most is originally bent upward and because the notch 72 facilitates the removal of the papers.

The above elements included in the inner tray 7 may be individually applied even to the trays 38 and 48. The angle θ of the bent portion 71 may be suitably selected in consideration of the maximum number of papers that can be stacked on the tray 7, such that the papers do not slip down even when the tray 7 is bent most and such that the tray 7 does not obstruct the removal of papers from the tray 38. The leg 73 is so positioned as not to obstruct the stacking of papers on the tray 38. The bent portion 71 should only be located at a position where the inner tray 7 bends downward most when loaded with papers. In this sense, either one of the edges of the tray 7 adjoining the corner 77 may entirely bent upward. The space 100 should only be open at least at its side where papers should be picked up. Further, a plurality of inner trays 7 may be arranged one above the other in the allowable range of the space 10, taking account of the paper discharge mechanism and the number of papers to be stacked.

As stated above, the illustrative embodiment has various unprecedented advantages, as enumerated below.

(1) The tray is partly bent upward to form the bent portion. Therefore, even when the tray bends due to the weight of papers stacked thereon, the papers are prevented from slipping down. Further, the bent portion forms at least a part of the tray bending downward most due to the weight of the papers, thereby preventing the papers from slipping down. This makes it needless to increase the volume of the tray and obviates troubles ascribable to the deformation of the tray.

(2) The above tray is implemented as the inner tray disposed in the space which is open to the outside at at least one side thereof. The image forming apparatus therefore does not need an exclusive area for the tray and needs a minimum of area for installation. In addition, troubles ascribable to the deformation of the inner tray are obviated.

(3) The inner tray is supported at its upstream portion in the direction of paper conveyance to the tray and at its upstream portion in the direction of removal of papers from the tray. The bent portion is positioned at the downstream corner. With this configuration, the inner tray successfully prevents the papers from slipping down when the papers are stacked on the tray or removed the tray. This also obviates troubles ascribable to the deformation of the tray without increasing the volume of the tray for reinforcement.

(4) The notch formed in the inner tray at the downstream side in the direction of removal of papers allows the operator to easily nip the portion of the papers positioned in the nip. This also obviates troubles ascribable to the deformation of the inner tray while reducing the volume of the tray.

(5) Because the bent portion of the inner tray is directed upward, the inner tray does not obstruct the discharge of papers to the tray positioned below the inner tray or the removal of the papers from such a tray. This, coupled with the notch facilitating the removal of papers, allows a great number of papers to be stacked on the inner tray, makes the inner tray easy to use, and obviates troubles ascribable to the deformation of the tray without increasing the volume of the tray.

Second Embodiment

This embodiment is directed mainly toward the second object stated earlier and will be described with reference to FIGS. 7–12B.

Figure 7:
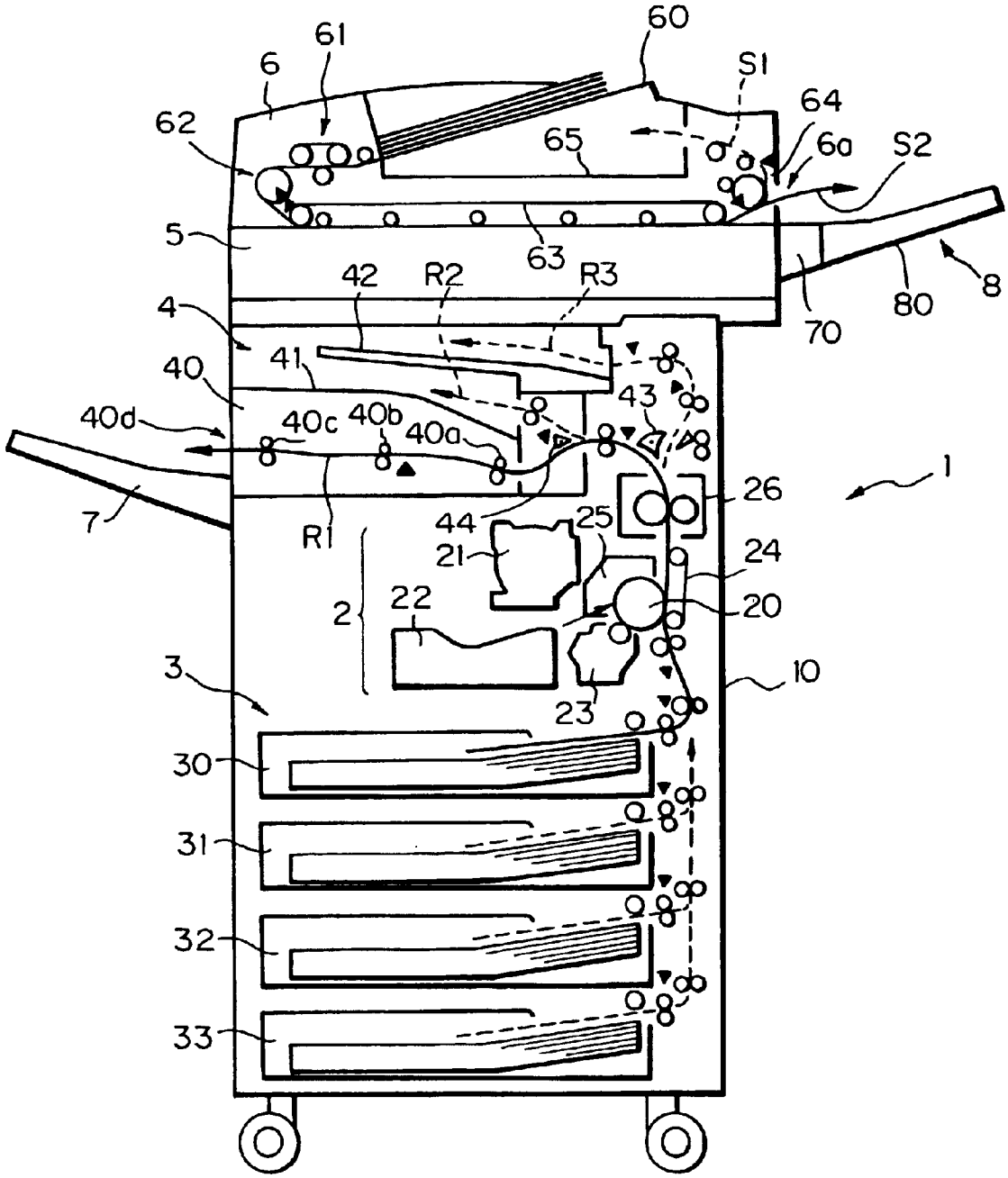
FIG. 7 is a front view showing a second embodiment of the present invention.

As shown in FIG. 7, an image forming apparatus is implemented as a copier 1 and includes an image forming section 2 arranged at substantially the center. A paper feed section 3 and a paper discharge section 4 are respectively arranged below and above the image forming section 2. A scanner 5 is positioned above the paper discharge section 4. An ADF (Automatic Document Feeder) 6 is located above the scanner 5. The image forming section 2, paper feed section 3 and paper discharge section 4 constitute a copier body 10. The copier body 10 conveys papers from the paper feed section 3 to the paper discharge section 4 via the image forming section along a substantially vertical path. In FIG. 7, a number of solid triangles are representative of paper sensors.

The image forming section 2 includes a photoconductive element in the form of a drum 20. Arranged around the drum 20 are a charger, not shown, for uniformly charging the surface of the drum 20, a writing unit 22 for scanning the charged surface of the drum 20 with a laser beam in accordance with image data output from the scanner 5, a developing unit 23 for developing a latent image formed on the drum 20 with toner, an image transfer device 24 for transferring the resulting toner image to a paper, and a cleaning unit 25 for removing toner left on the drum 20 after image transfer. A fixing unit 26 is positioned downstream of the drum 20 in the direction of paper conveyance for fixing the toner image transferred to the paper. The reference numeral 21 designates a device for replenishing toner to the developing unit 23.

The paper feed section 3 includes cassettes 30, 31, 32 and 33 each storing papers of a particular size or storing papers in a particular orientation. A pick-up roller and conveyor rollers are associated with each of the cassettes 30–33 for feeding the papers to a paper conveyance path. A manual feed tray, not shown, is angularly movably mounted on one side of the copier body 10 for allowing the operator to feed papers by hand, as needed.

The scanner 5 scans a document laid on a glass platen, not shown, and outputs image data representative of the document. The image data are sent to the writing unit 22. The writing unit 22 electrostatically forms a latent image on the drum 20 in accordance with the image data, as stated earlier.

The paper discharge section 4 includes a transfer conveying unit 40 for driving the papers sequentially coming in through the fixing section 26 to the outside of the copier body 10. A tray 41 is formed on the top of the transfer conveying unit 43. A bin tray 42 is positioned between the top of the tray 41 and the underside of the scanner 5. A path extending from the fixing unit 26 branches into three paths extending to the transfer conveying unit 40, tray 41, and bin tray 42, respectively. Path selectors 43 and 44 selectively steer papers to any one of the above branch paths.

Conveyor rollers 40*a*, 40*b* and 40*c* are arranged in the transfer conveying unit 40. A tray 7 is removably mounted to one side of the copier body 10 adjoining the outlet 40*d* of the conveying unit 40. Papers driven out of the copier body 10 via the conveying unit 40 are sequentially stacked on the tray 7.

The ADF 6 has a conventional construction and will be briefly described hereinafter. A plurality of documents are stacked on a document tray 60. A feed roller 61 sequentially feeds the lowermost document from the tray 60 to a turn-over section 62. The turn-over section 62 conveys the document to between a conveyor belt 63 and the glass platen while turning it over. After the document has been read by the scanner 5, a turn-over section 64 discharges the document to a tray 65 positioned below the tray 60 while turning it over again (discharge path S1).

Figure 8:
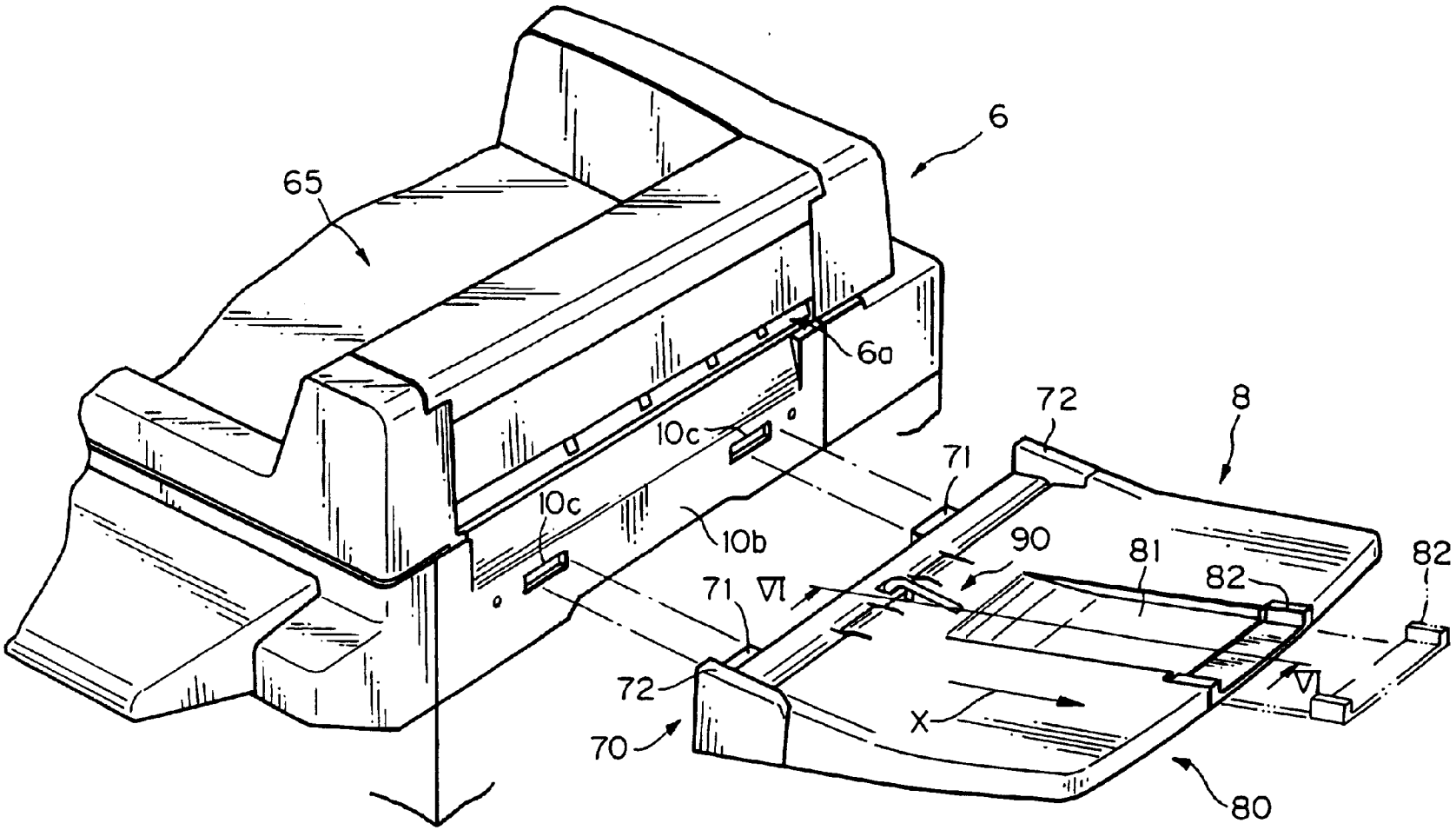
FIG. 8 is a perspective view showing a tray included in the second embodiment and mounted to the document outlet of an ADF (Automatic Document Feeder)
Figure 9:
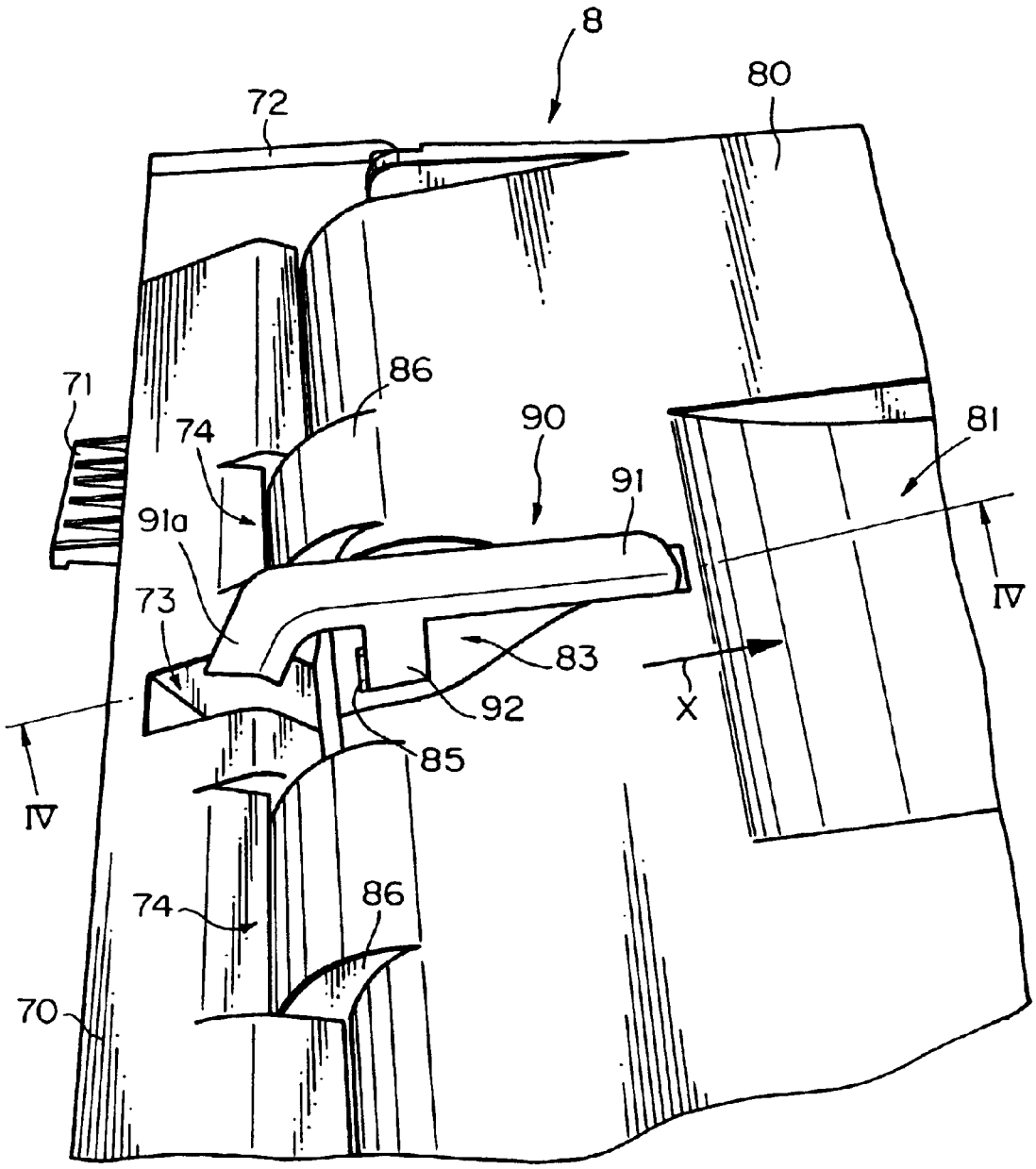
FIG. 9 is an enlarged perspective view showing an anti-roll member also included in the second embodiment and its neighborhood.

As shown in FIGS. 7 and 8, a document outlet 6*a* is formed between the conveyor belt 63 and the turn-over selection 64 for discharging the document to the outside of the ADF 6. A tray 8 is removably mounted to the side wall 10*b* of the copier body 10 in the vicinity of the document outlet 6*a* of the ADF 6. The document conveyed by the belt 63 may therefore be driven out to the tray 8 along a path S2 indicated by a solid line in FIG. 7. The tray 8 will be described specifically later. When the consecutive documents are driven out to and stacked an the tray 8, they do not have to be turned over twice. This successfully reduces the document conveying time.

An image forming process to be executed by the copier 1 is as follows. After the charger has uniformly charged the surface of the drum 20, the writing unit 22 electrostatically forms a latent image on the drum 20 in accordance with image data output from the scanner 5. When the latent image is brought to a position where it faces the developing unit 23, the developing unit 23 develops the latent image with toner. Papers automatically selected or selected by the operator are sequentially fed from one of the cassettes 30–33 located in the paper feed section 3.

Each paper is conveyed such that its leading edge meets the leading edge of the toner image carried on the drum 20. The image transfer unit 24 transfers the toner image from the drum 20 to the paper. The cleaning unit 25 removes the toner left on the drum 20 after the image transfer.

The paper brought to the paper discharge section 4 is conveyed to the tray 7, tray 42 or bin tray 42 along one of the previously mentioned three different paths, i.e., paths R1, R2 and R3. The path R1, indicated by a solid line, extends to the tray 7. The path R2, indicated by a dotted line, extends to the tray 41. The path R3, indicated by a dotted line, extends to the bin tray 42. The paths R1 and R2 and the path R3 are switched by the path selector 43 while the paths R1 and R2 are switched by the path selector 44.

As shown in FIG. 8, the tray 8 is made up of two trays 70 and 80 respectively positioned at the upstream side and downstream side in the direction of paper discharge X. A pair of holes 10*c* are formed in the side wall 10*b* of the copier body 10 below the document outlet 6*a*. A pair of hooks 71 protrude from one edge of the tray 70 facing the side wall 10*b* and are engageable with the holes 10*c*.

Figure 12B:
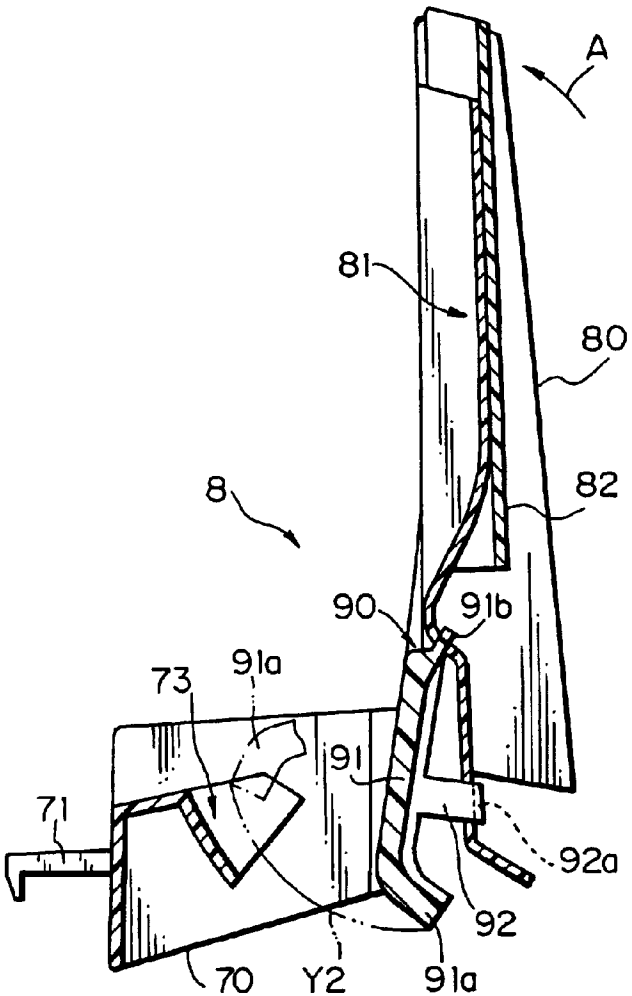
FIGS. 12A and 12B are sections along line VI—VI of FIG. 8.
Figure 12A:
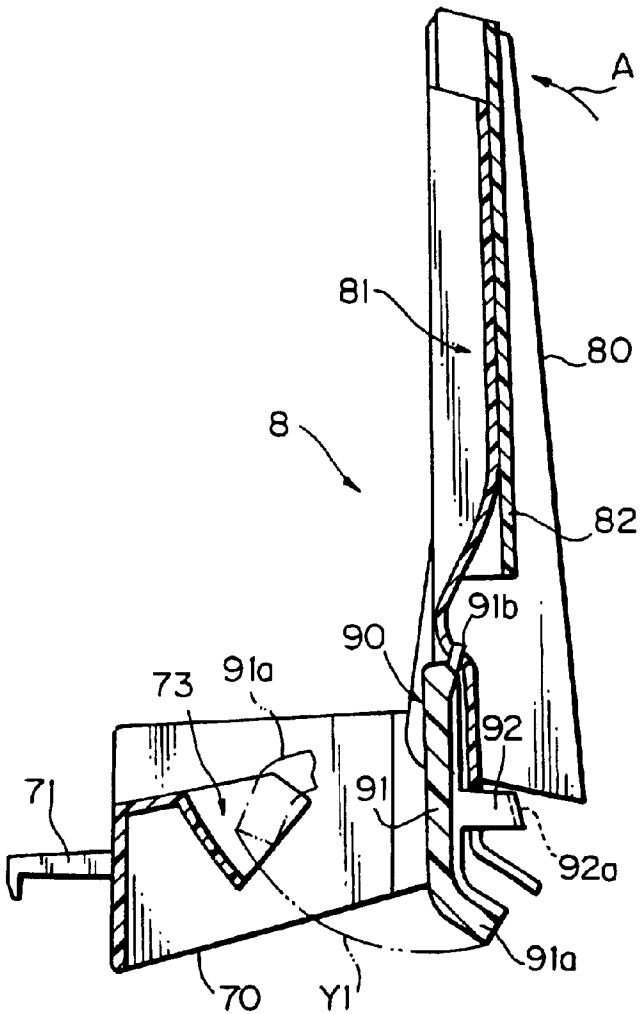

Guide walls 72 extend upward from opposite side edges of the tray 70 and are elongate in the direction X for guiding the side edges of the document. The tray 80 is supported by the guide walls 72 via rotating means not shown. The rotating means is made up of a shaft and a recess receiving the shaft. The shaft and recess are provided on the trays 80 and 70, respectively. As shown in FIGS. 12A and 12B, the tray 80 is rotatable about the shaft in such a manner as to fold upward.

One edge of the tray 70 and one edge of the tray 80 adjoin each other such that their upper surfaces smoothly merge into each other. The tray 70 has a length in the direction X which is smaller than the length of the tray 80, so that the tray 80 protrudes from the side wall 10*b* of the ADF 6 by only a small amount when rotated.

A recess 81 is formed in the tray 80 at substantially the center in the widthwise direction of the document. The recess 81 extends from the intermediate portion to the downstream edge of the tray 80 in the direction X. An extension tray 82 is mounted on the edge portion of the tray 80 remote from the tray 70 and has substantially the same cross-sectional shape as the recess 81. The extension tray 82 is slidable along the recess 81. When the extension tray 82 is pulled out, as indicated by a dash-and-dots line in FIG. 8, it provides the tray 8 with an additional area for stacking the documents.

An anti-roll member 90 is mounted on the tray 80 at substantially the center in the widthwise direction of the document in the vicinity of the tray 70. The anti-roll member 90 stiffens the document being discharged from the ADF 6 and thereby prevents it from rolling. The amount of projection of the anti-roll member 90 above the top of the tray 80 is adjustable in two steps, as will be described later in detail.

The anti-roll member 90 is implemented as a single molding of synthetic resin. As shown in FIGS. 9, 10A, 10B, 11A and 11B, the member 90 is made up of a body 91 having a generally V-shaped cross-section (see FIGS. 11A and 11B) and a pair of arms 92 extending downward from the body 91. The upstream end portion of the body 91 in the direction X is inclined in such a manner as to rise toward the downstream side in the direction X, forming an inclined portion 91*a*. The inclined portion 91*a* protrudes toward the tray 70 over the edge of the tray 80 in such a manner as to cover the tray 70. By positioning the inclined portion 91*a* close to the outlet 6*a* of the ADF 6, it is possible to prevent the document from rolling.

The document being discharged from the outlet 6*a* contacts the inclined portion 91*a* and is smoothly guided by the body 91. As a result, the document is stiffened and neatly stacked on the tray 8.

The downstream end of the body 91 in the direction X terminates at a rod-like portion 91*b* for retaining the anti-roll member 90 on the tray 80. Each arm 92 has a stop 92*a* at its lower end in order to lock the member 90 in position when the projection of the member 90 above the tray is increased. The stop 92*a* is bent outward away from the associated arm 92.

Figure 11A:
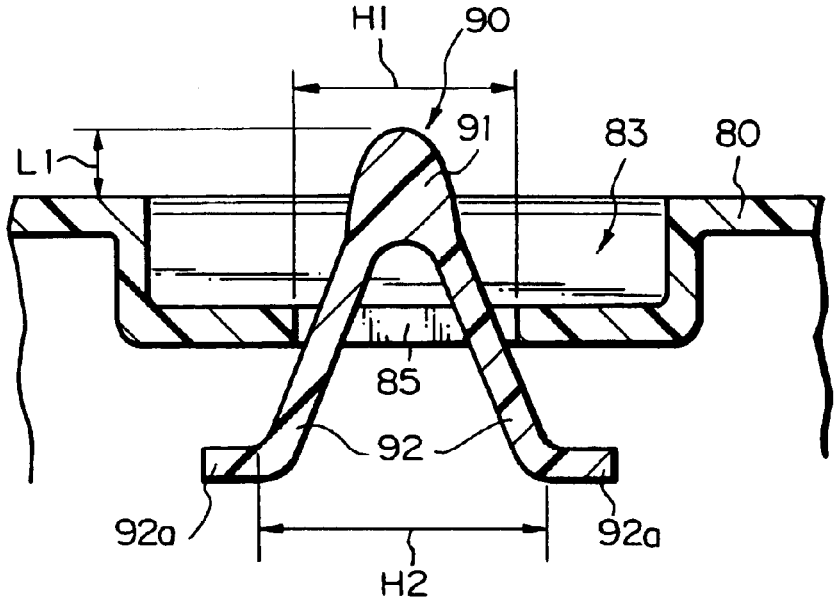
FIGS. 11A and 11B are sections along line V—V of FIGS. 10A and 10B, respectively.

A recess 83 is formed in the portion of the tray 80 where the anti-roll member 90 is present. The recess 83 is flared toward the edge of the tray 80. A hole 84 is formed in the bottom of the narrowest portion of the recess 83 and engageable with the portion 91*b*. A hole 85 is formed in the bottom of the recess 83 for receiving the arms 92. As shown in FIG. 11A, the hole 85 has a length H1 in the direction corresponding to the arms 92 which is smaller than the length H2 of the arms 92 not including the stops 92*a*, so that the arms 92 are preventing from slipping out of the hole 85. The member 90 is therefore retained on the tray 80 with the arms 92 mating with the hole 85 and the portion 91*b* mating with the hole 84.

Fingers 86 protrude from the tray 80 at both sides of the anti-roll member 90. When documents are stacked on the tray 80, the fingers 86 transfer the weight of the documents to the tray 70.

A notch 73 is formed in the portion of the tray 70 corresponding to the inclined portion 91*a* in order to prevent the tray 70 from interfering with the inclined portion 91*a* when the tray 80 is rotated. Flat portions 74 are positioned on the tray 70 at both sides of the notch 73 for receiving the fingers 86 of the tray 80.

How the amount of projection of the anti-roll member 90 is adjusted and how the tray 80 is rotated will be described hereinafter.

Figure 10A:
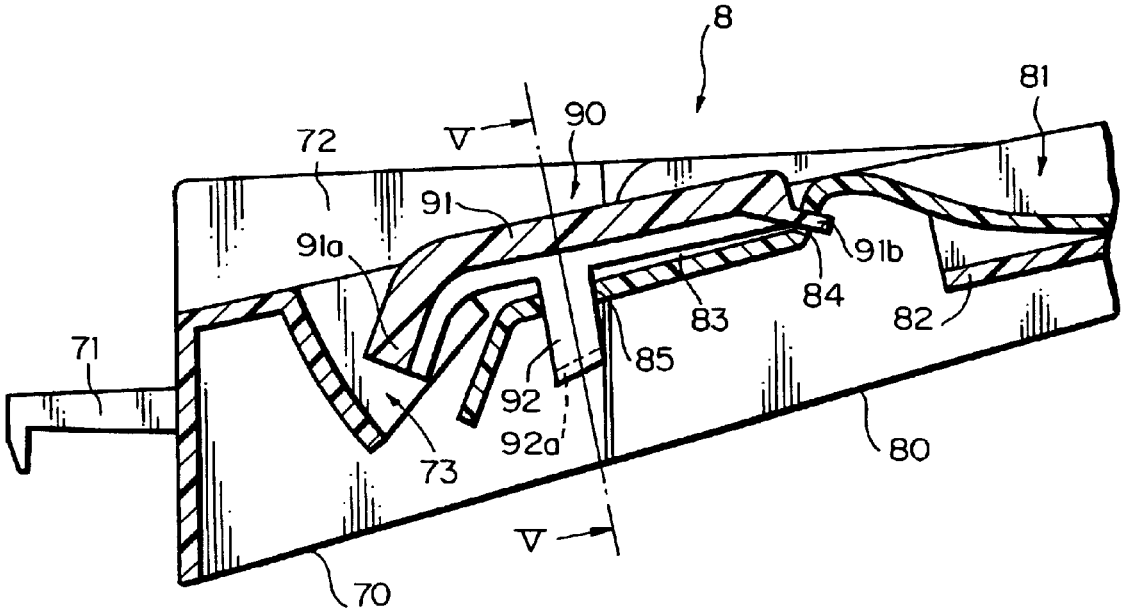
FIG. 10A is a section along line IV—IV of FIG. 9, showing a condition wherein the amount of projection of the anti-roll member is small.
Figure 10B:
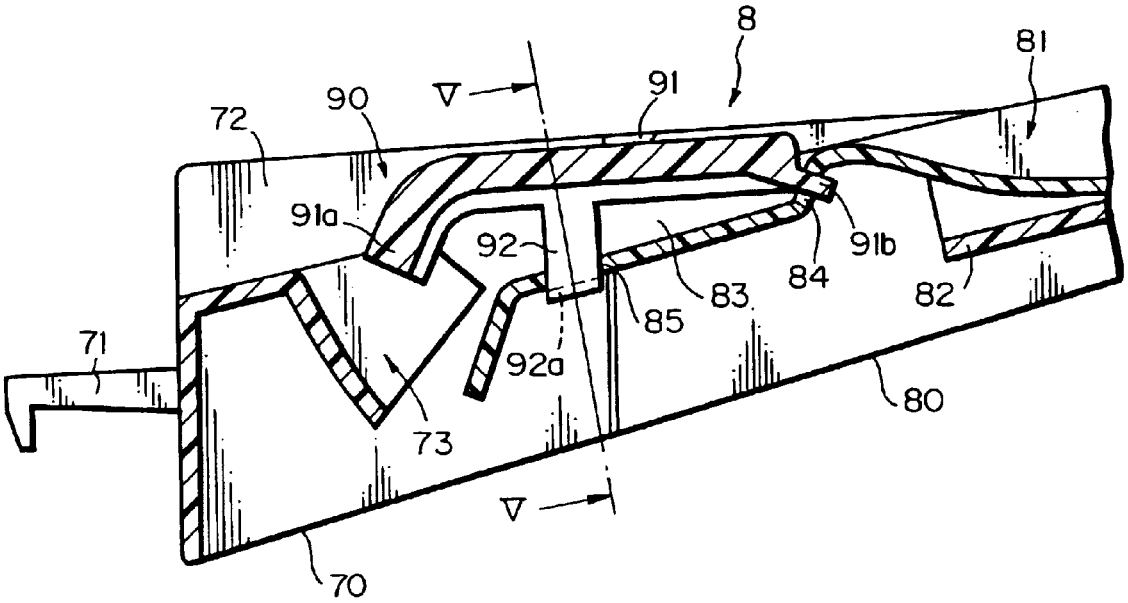
FIG. 10B is a view similar to FIG. 10A, showing another condition wherein the amount of projection is great.

As for the projection of the member 90, as shown in FIGS. 10A and 11A, the end faces of the arms 92 abut against the edges of the hole 85 while the portion 91*b* abuts against the edge of the hole 84, retaining the member 90 in the recess 83. In this condition, the body 91 of the member 90 protrudes above the top of the tray 8 by a comparatively small length L1.

Figure 11B:
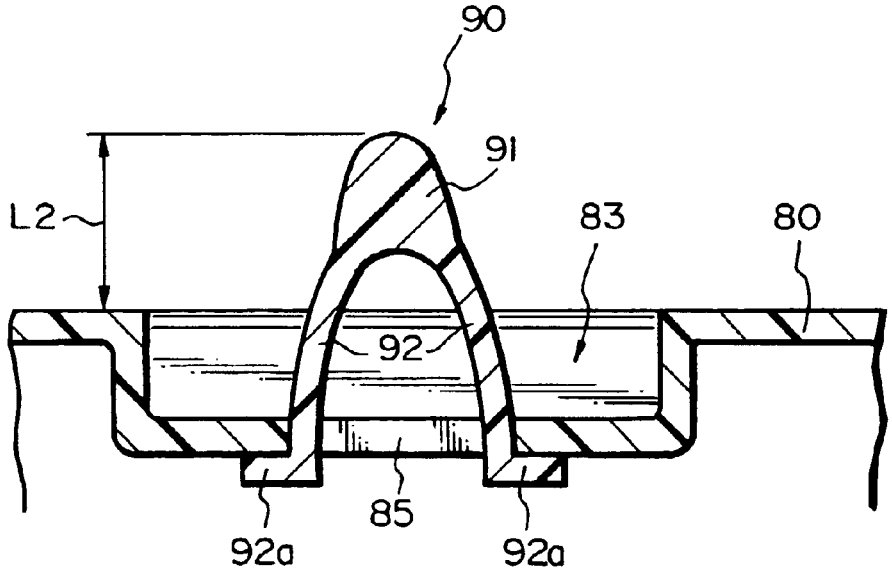

The operator nips the body 91 of the member 90 held in the above small length position and lifts it. Because the length H1 is smaller than the length H2, the arms 92 elastically deform in contact with the edges of the hole 85, as shown in FIG. 11B. As the operator further lifts the body 91, the stops 92*a* abut against the underside of the tray 8 around the hole 85. At this instant, the arms 92 elastically deform toward each other and therefore tend to deform away from each other, surely locking the body S1 in position. In this condition, the body 91 protrudes above the top of the tray 8 by a length L2 greater than the length L1.

To reduce the length L2 to the length L1, the operator again nips the arms 92, causes them to elastically deform toward each other, causes the stops 92*a* to move way from the hole 85, and then pushes the arms 92 downward. The flared recess 83 allows the operator to easily nip the arms 92.

When the documents are relatively short in the direction X, e.g., when they are of size B5 or A4, the amount of projection of the anti-roll member 90 is reduced in order to stiffen the documents and thereby promotes neat stacking. When the documents are relatively long in the direction X, e.g., when they are of size A3, the amount of projection of the member 90 is increased for stiffening the documents while the extension tray 82 is pulled out to increase the area of the tray 8. In this manner, the projection of the member 90 is adjustable in accordance with the document size, so that the documents can be adequately stiffened and neatly stacked on the tray 8.

As for the rotation of the tray 80, as shown in FIG. 12A, when the tray 80 with the member 90 held in its small projection position is rotated in a direction A, the inclined portion 91*a* moves from a position indicated by a dash-and-dots line to a position indicated by a solid line. At this instant, the edge of the inclined portion 91*a* moves along a locus Y1 and does not interfere with the tray 70. As shown in FIG. 12B, when the tray 80 is rotated with the member 90 held in its great projection position, the inclined portion 91*a* moves from a position indicated by a dash-and-dots line to a position indicated by a solid line. At this instant, the edge of the inclined portion 91*a* moves along a locus Y2 and does not interfere with the tray 70.

As stated above, when the tray 80 is rotated, the anti-roll member 90 does not interfere with a part of the tray 8, i.e., the tray 70. This makes it needless for the member 90 to be removable from the tray 8 or to be removed from the tray 8 every time the tray 80 is rotated, thereby facilitating the rotation of the tray 80. Whether the projection of the member 90 be great or not, the member 90 does not interfere with the tray 70 and is therefore free from damage.

While the tray 80 has been shown and described as being rotatable in the direction A, it may be rotatable in the opposite direction, i.e., downward. Also, the anti-roll member 90 may be mounted on the tray 70. The configuration of the tray 8 is similarly applicable to a tray for stacking papers formed with images or a tray included in a finisher, if desired.

The above illustrative embodiment achieves the following advantages.

(1) Wen the downstream tray is rotated, the anti-roll member does not interfere with the upstream tray. This makes it needless for the anti-roll member to be removable from the tray or to be removed from the tray every time the downstream tray is rotated, thereby facilitating the rotation of the downstream tray.

(2) The amount of projection of the anti-roll member above the tray is adjustable in accordance with the paper size, so that the documents can be adequately stiffened and neatly stacked on the tray. Whether the projection of the member be great or not, the member does not interfere with the upstream tray and is therefore free from damage.

(3) The position where the upstream and downstream trays are separate from each other is position in the vicinity of the upstream edge of the upstream tray in the direction of document discharge. It follows that the tray protrudes little when the downstream tray is rotated, reducing the overall size of the apparatus.

(4) The upstream end portion of the anti-roll member rises toward the downstream side and smoothly guides the leading edge of the document being discharged onto the tray.

Third Embodiment

This embodiment is mainly directed toward the third object stated earlier and will be described with reference mainly to FIGS. 13A–17.

Figure 13A:
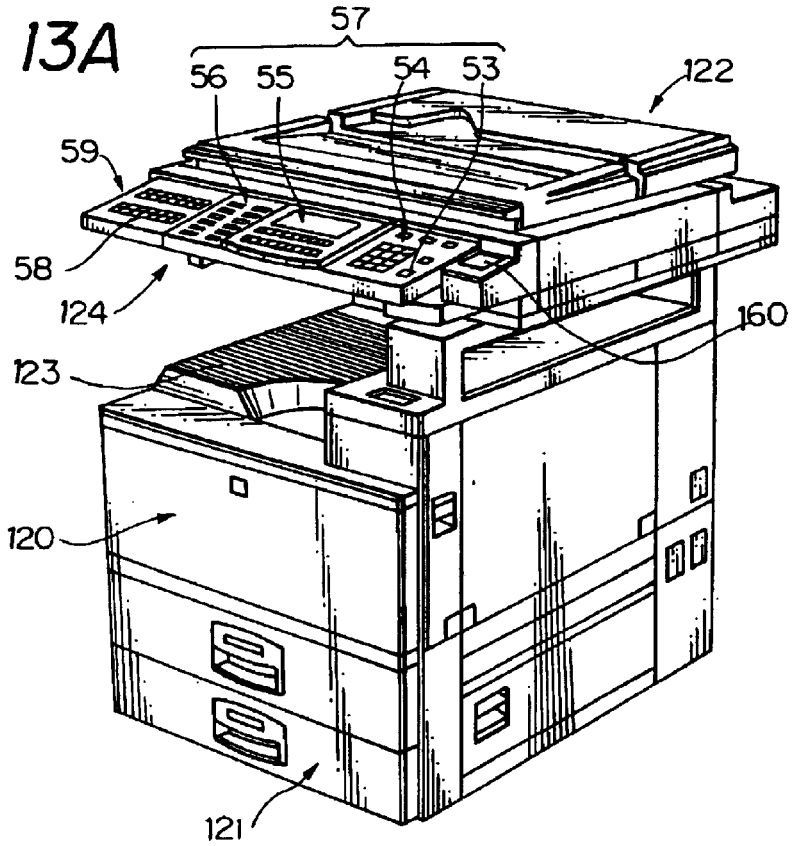
FIGS. 13A and 13B are perspective views showing a third embodiment of the present invention.
Figure 13B:
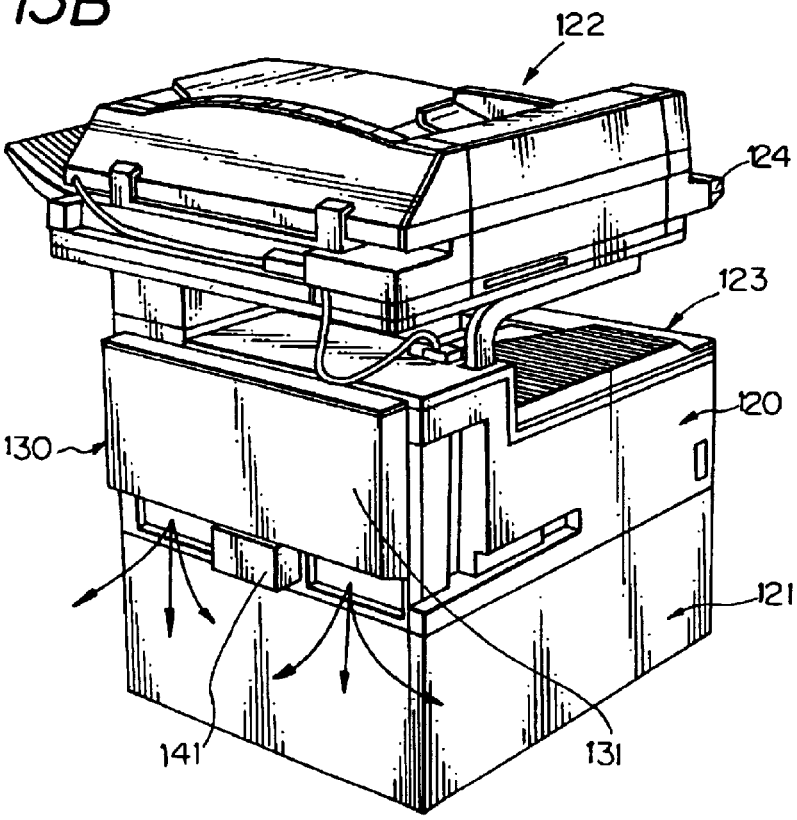

FIGS. 13A and 13B show an image forming apparatus in a front perspective view and a rear perspective view, respectively. The apparatus is a multiplex machine having a facsimile function and/or a printer function in addition to a copier function. As shown, the apparatus has an image forming section or printer center 120 at substantially its center. A two-stage paper feed section 121 is positioned beneath the image forming Section 120. A scanner 122 is positioned above the image forming section 120 with the intermediary of a space which is open to the outside at the front side and left side (as viewed in FIG. 13A). The above space plays the role of a paper stacking section 123. An operating section 124 having various functions is positioned on the front portion of the apparatus body.

The apparatus 120 has thereinside a photoconductive element or image carrier, an optical writing unit for electrostatically forming a latent image on the photoconductive element, a charger for charging the photoconductive element, a developing unit for developing the latent image with toner, an image transfer unit for transferring the resulting toner image to a paper, and a fixing unit for fixing the toner image on the paper, although not shown specifically. The fixing unit generates heat more than the other structural elements of the apparatus.

The operating section 124 is made up of a copier function panel 57 including a copy start key 53, numeral keys 54, an LCD (Liquid Crystal Display) 55 and a copier operating section 56, and a facsimile function panel 59 including dial keys 58. The panels 57 and 59 extend over substantially entire width of the paper storing section 123. The reference numeral 160 designates a power switch.

Figure 14:
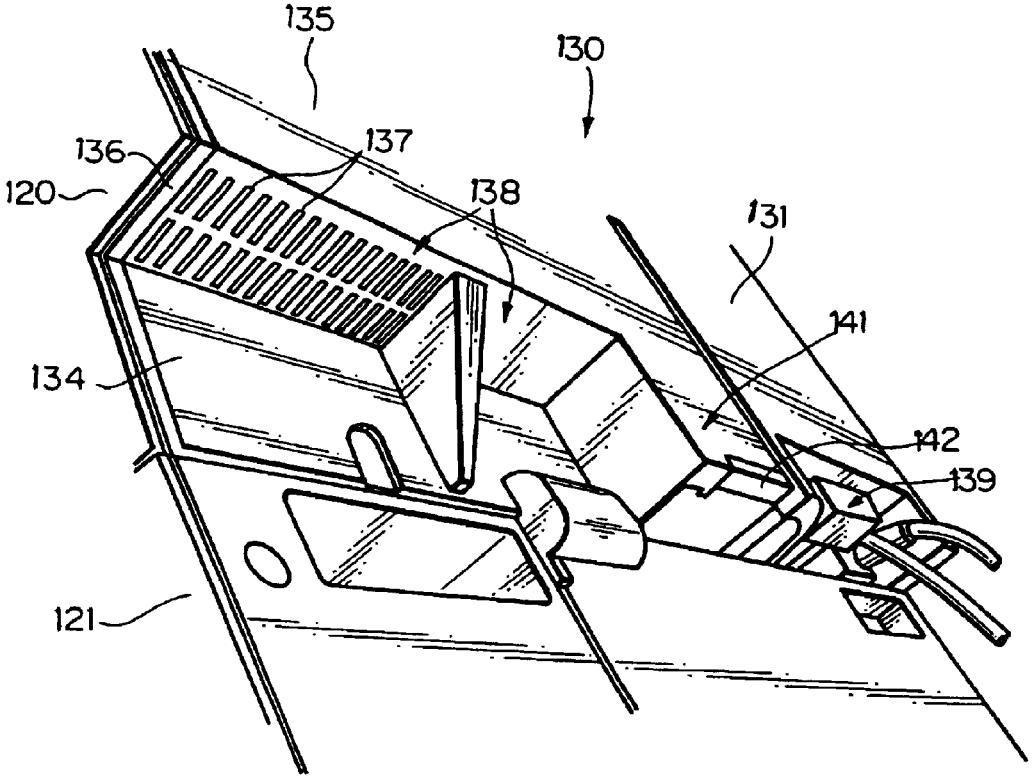
FIG. 14 is an enlarged perspective rear view of the third embodiment as seen from below.

As shown in FIG. 13B, the image forming section 120 is formed with a ventilation portion 130 at its rear end. As best shown in FIG. 14, the ventilation portion 130 is stepped such that it protrudes to the rear more than the paper feed section 21.

Figure 15:
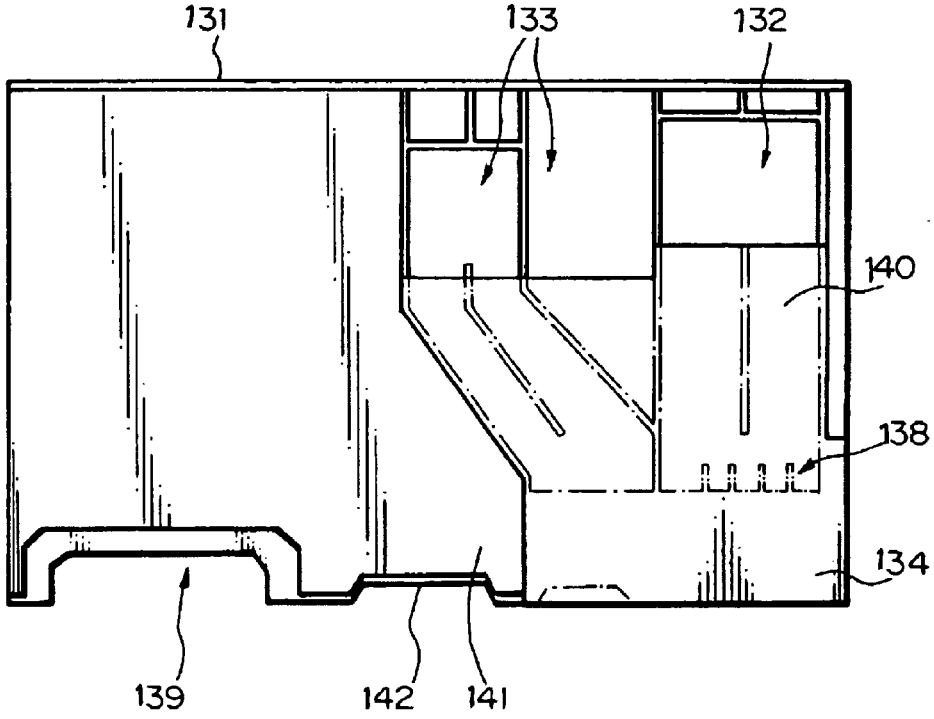
FIG. 15 is a front view showing the internal configuration of panels constituting a ventilation arrangement in the third embodiment.
Figure 16:
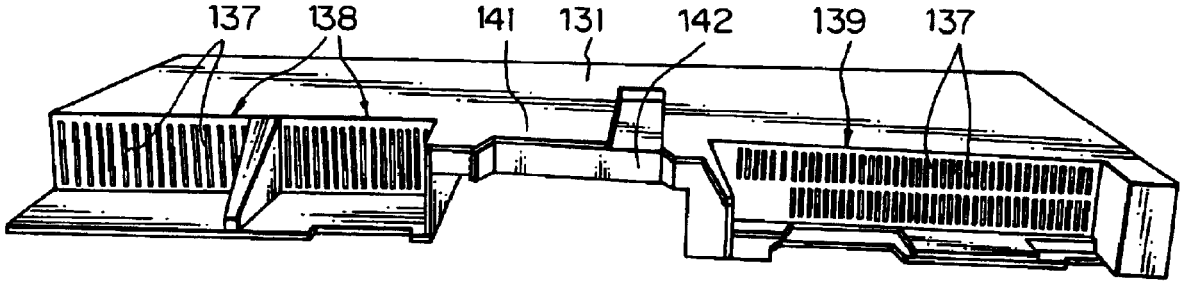
FIG. 16 is a perspective bottom view showing en air inlet, an air outlet and a grip portion included in the third embodiment.

As shown in FIGS. 14–16, the ventilation portion 130 includes a panel 131 mounted to the rear of the image forming section 120 and fans, not shown, respectively received in recesses 132 and 133 formed in the inside of the panel 131. If desired, a single fan maybe disposed in either one of the recesses 132 and 133. The panel 131 includes a lower part 134 flush with the rear of the paper feed section 121, an upper part 135 protruding to the rear more than the rear of the paper feed section 121, and a shoulder 136 connecting the upper part 134 and lower part 135. The recesses 132 and 133 are formed in the inside of the upperpart 135. The shoulder 136 is formed with an air outlet 138 and an air inlet 139 each being implemented by a number of slits 137. The recesses 132 and 133 each has its lower portion covered with a panel 140 except for the portion far receiving the fan, thereby forming a ventilation path. The surface of the panel 131 forms the rear of the apparatus 120 and is formed flat, so that the apparatus can be situated in close proximity to, e.g., the wall of a room.

A suction fan may be provided on the air inlet 139 side. Even when such a fan is absent, the exhaust of air via the air outlet 138 produces a pressure difference between the inside and the outside of the apparatus, causing air to be naturally circulated. In the illustrative embodiment, a connector for power supply and other electrical parts are positioned below the air inlet 139, but they do not obstruct ventilation so long as they do not close the air inlet 139 over a broad area.

A grip portion 141 intervenes between the air outlet 138 and the air inlet 139 and extends downward from the intermediate portion of the upper part 135 to the bottom of the lower part 134. The intermediate portion of the grip portion 141 is slightly recessed upward from the lower edge, constituting a catch 142. The catch 142 is provided with a substantial thickness for enhancing mechanical strength. With this configuration, the catch 142 does not deform or break when subjected to a force during e.g., transport. As shown in FIG. 14, the catch 141 separates the air outlet 138 and air inlet 139 so as to prevent an outgoing air stream and an incoming air stream from obstructing each other.

Figure 17:
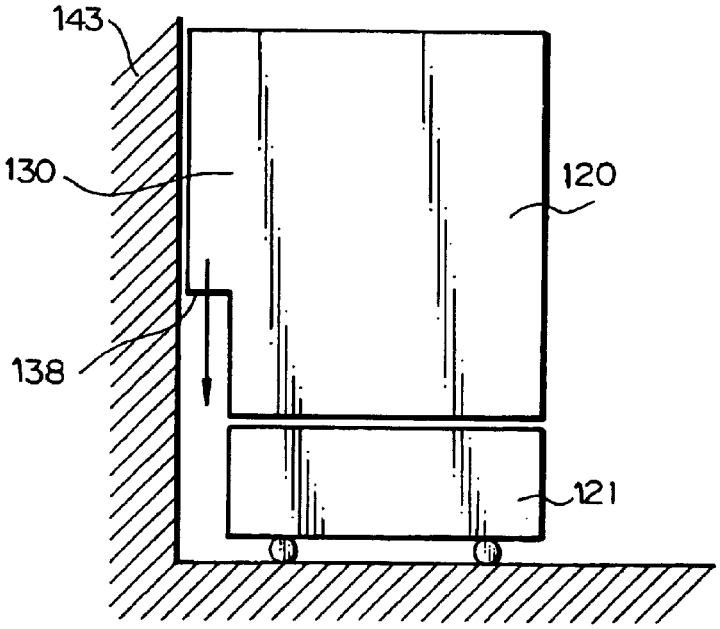
FIG. 17 is a side elevation demonstrating a stream of air achievable with the third embodiment.

As shown in FIG. 17, assume that the apparatus is operated with is rear contacting a wall 143. Then, hot air is emitted from the inside to the outside of the apparatus 120 via the air outlet 138 and then caused to flow down between the lower part 134 of the panel 131 and rear of the paper feed section 121 and the wall 143. This stream of air is, in many cases, higher in temperature than surrounding air and eventually flows upward via the space around the side and rear of the apparatus 120. However, such an air stream is mixed with surrounding air. Therefore, although the air stream may turn round to the front of the apparatus 120 where the operator is expected to stand, the operator will feel it hot or warm little.

As stated above, the above embodiment has the following unprecedented advantages.

(1) The stepped portion provided on the rear of the apparatus has an upper part protruding to the rear more than a fewer part. An air outlet for ventilation is formed in the stepped portion and directed downward. In this configuration, hot air emitted from the apparatus is caused to flow downward along the rear of the apparatus. The hot air therefore turns round to the front of the apparatus little or is mixed with surrounding air and cooled off before turning round to the front. This frees the operator of the apparatus from unpleasantness.

(2) A grip portion is formed in the stepped portion other than a position where the air outlet is present, facilitating, e.g., the transport of the apparatus.

(3) The grip portion is recessed from the outermost edge of the stepped portion, forming a catch. This also facilitates, e.g., the transport of the apparatus while protecting the fragile air outlet from damage.

(4) The grip portion protrudes downward from the upper edge of the stepped portion while the air outlet and an air inlet are positioned at opposite sides with respect to the grip portion. This prevents an incoming air stream and an outgoing air stream from obstructing each other.

Various modifications will become possible for those skilled in the art after receiving the teachings of the present disclosure without departing from the scope thereof.

What is claimed is:

1. An image forming apparatus comprising:

an apparatus body; and a ventilation portion disposed on a back surface of the apparatus body, the ventilation portion comprising:

a panel including an upper part, a lower part, and a shoulder disposed between the upper and lower parts, the shoulder including an air inlet, an air outlet, and a grip portion, the grip portion extending from the upper part to the lower part and disposed between the air inlet and the air outlet to isolate a portion of an air inlet path from a portion of an air outlet path.

2. The apparatus as claimed in claim 1, wherein said grip portion is recessed from an outermost edge of said lower part.

3. The apparatus as claimed in claim 2, wherein said air outlet and air inlet comprise a plurality of slits.

4. The apparatus as claimed in claim 1, wherein the upper part includes at least one recess adapted to retain a fan.

5. The apparatus as claimed in claim 4, where the at least one recess comprises two recesses.

6. The apparatus as claimed in claim 5, further comprising:

a fan disposed in one of the recesses.

7. The apparatus as claimed in claim 1, wherein the air outlet is configured to direct air downward toward the lower part.

8. The apparatus as claimed in claim 1, wherein the grip portion is recessed to form a catch, the catch disposed between the air inlet and the air outlet to isolate the portion of the air inlet path from the portion of the air outlet path.

* * * * *